US005112118A

United States Patent [19]

Wiehle

[11] Patent Number: 5,112,118

[45] Date of Patent: May 12, 1992

[54] COUNTER WITH PIVOTABLE FRONT PANEL

[75] Inventor: Franz Wiehle, Iserlohn, Fed. Rep. of Germany

[73] Assignee: Gerd und Bernd Vieler KG, Iserlohn, Fed. Rep. of Germany

[21] Appl. No.: 574,298

[22] Filed: Aug. 28, 1990

[30] Foreign Application Priority Data

Sep. 2, 1989 [DE] Fed. Rep. of Germany ..... 3929218
Jan. 16, 1990 [DE] Fed. Rep. of Germany ..... 4000975
Feb. 16, 1990 [DE] Fed. Rep. of Germany ..... 4004796

[51] Int. Cl.[5] ..... E05F 11/24

[52] U.S. Cl. ..... 312/116; 49/340; 49/344

[58] Field of Search ..... 49/334, 340, 344; 312/116

[56] References Cited

U.S. PATENT DOCUMENTS 2,481,989 9/1949 Eddison ..... 49/340 X
4,337,670 7/1982 Carlson ..... 49/340 X
4,842,349 6/1989 Stenemann ..... 312/116

*Primary Examiner*—Joseph Falk
*Attorney, Agent, or Firm*—Peter K. Kontler

[57] ABSTRACT

A display counter wherein the upper portion of the case has several upwardly and forwardly sloping hollow supports for modules which pivotably mount one or more front panels each of which can be moved to a first position in which it overlies the customer side of the counter and a raised second position in which the internal space of the counter in accessible from the customer side. The modules include linear actuators which can pivot the front panel or panels between the first and second positions as well as to one or more intermediate positions. Each actuator is pivotally secured to a frame of the respective module at the lower end of the corresponding support and to a hinge for a front panel at the upper end of the support. The pintle of the hinge is mounted in the upper end portion of the corresponding frame.

42 Claims, 6 Drawing Sheets

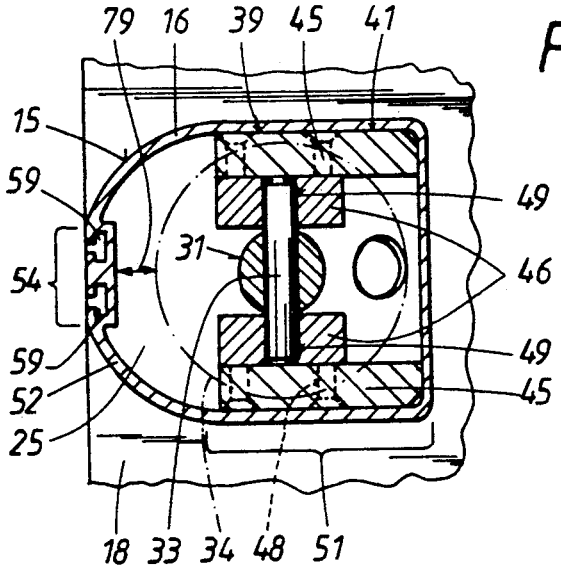
FIG. 4
FIG. 5
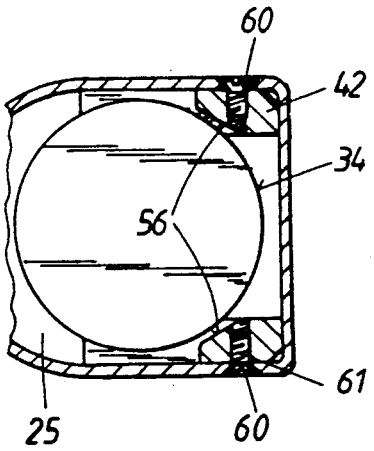
FIG. 6
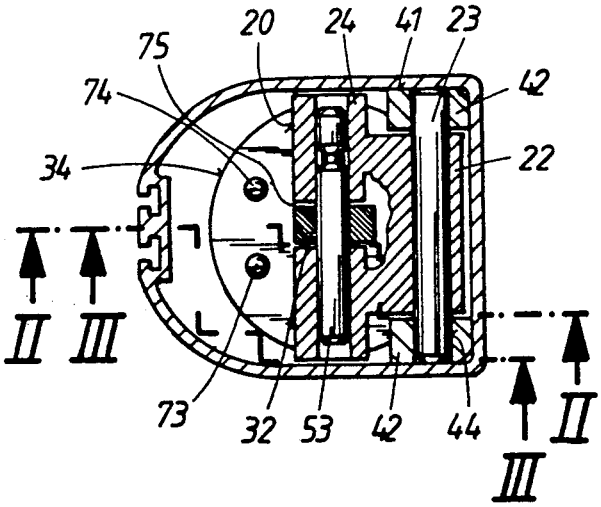
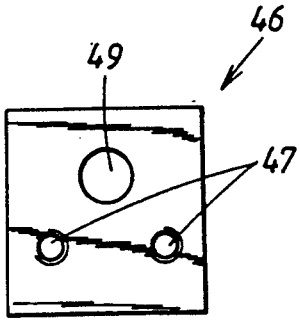
FIG. 9

COUNTER WITH PIVOTABLE FRONT PANEL

BACKGROUND OF THE INVENTION

The invention relates to improvements in counters for storage and displaying of commodities (e.g., foodstuffs) in supermarkets, ice cream parlors, butcher shops, sandwich shops and many other establishments. More particularly, the invention relates to improvements in counters which can be utilized with advantage as refrigerators for perishable commodities. Still more particularly, the invention relates to improvements in counters of the type having one or more front panels at the customer or front side to normally prevent access to the confined and displayed commodities.

It is desirable and advantageous to mount the front panel or panels of a counter in such a way that each front panel can be moved between an operative or closing position (in which it closes and seals the counter at the customer side) and an inoperative or open position in which an authorized person can gain access to the interior of the counter, e.g., to replace spoiled commodities, to remove commodities for the purposes of storage in a freezer while the establishment is closed, to permit convenient cleaning of the interior of the counter and/or for other purposes. Furthermore, it is often more convenient to introduce commodities into the counter at the customer side. As a rule, or at least in many instances, the front panel or panels are mounted for pivotal movement between their operative and open positions. This is achieved by mounting the rear marginal portion of each panel on at least two supports of the case of the counter. Such supports are component parts of the upper portion of the case and normally extend upwardly and forwardly to pivotably support one or more front panels as well as to support a counter top which serves for deposition of commodities by the clerk and for deposition of monies by the customers. Reference may be had to commonly owned U.S. Pat. No. 4,842,349 granted June 27, 1989 to Bruno Stenemann for "Display Counter".

Pivoting of the front panel or panels between operative and open positions is a tedious task, especially if a front panel includes a plurality of discrete panes of glass or other light-transmitting material. Therefore, many presently used front panels are of lightweight design and are relatively small in order to simplify the task of an attendant who must pivot the front panel to open position as well as to reduce the danger of damaging the front panel and/or other parts of the counter if a heavy front panel is free to descend by gravity toward its operative position. A lightweight front panel often comprises a single light-transmitting pane even though it is normally desirable to employ front panels with plural panes in order to save energy if the internal space of the counter is to be maintained well below room temperature or is to be isolated from the surrounding atmosphere for other reasons (e.g., to prevent entry of insects or contaminants). Moreover, moisture is less likely to deposit at the outer side of a front panel which comprises several light-transmitting panes.

Proposals to employ energy storing devices, such as gas springs, for the purpose of facilitating pivoting of a rather heavy and bulky front panel have met with limited success, mainly because it is still necessary to provide bolts and/or other locking or blocking devices in order to prevent accidental and abrupt pivoting of a front panel to its operative position. Moreover, the gas spring or springs must have an eye-pleasing appearance in order not to detract from the appearance of the counter or they must be fully concealed from view. Still further, a gas spring must be highly reliable and must be designed in such a way that it can be readily and safely manipulated by persons having little or no skill. Therefore, a counter which is equipped with gas springs normally still employs locking bolts and like devices which ensure that the front panel or panels can be maintained in selected position(s). The locking bolts detract from the appearance of the counter and cannot be readily manipulated by a person who is in the process of maintaining the front panel in a selected position other than the closed or operative position. Still further, gas springs are often ineffective if a front panel is very heavy and bulky so that, if permitted to undergo rapid acceleration, such bulky and heavy front panel is likely to injure an attendant or a customer or to suffer serious damage and cause damage to the adjacent parts of the counter. Pronounced inertia of a large and heavy front panel creates problems during acceleration as well as during braking. In addition, a heavy front panel is likely to damage the hinges at the upper ends of the supports, the gas springs and/or other parts of the counter. Repair work is expensive and takes up much time which is highly undesirable if the counter is used in a busy establishment which is visited by numerous customers and the contents of which must be replenished several times a day in order to satisfy the customer demand.

Manipulation of a front panel by more than one person is often impractical or not possible. Thus, two or more persons are not always available, e.g., after working hours when the contents of the counter must be removed to permit convenient and thorough cleaning of the space which serves for confinement of foodstuffs and/or other types of commodities.

OBJECTS OF THE INVENTION

An object of the invention is to provide a display counter wherein the front panel or panels can be moved with reference to the adjacent parts in a novel and improved way.

Another object of the invention is to provide a counter wherein the front panel or panels can be moved to and retained in fully open or fully closed positions as well as in any desired number of intermediate positions.

A further object of the invention is to provide novel and improved means for moving the front panel or panels in a display counter for foodstuffs and/or other perishable or non-perishable commodities.

An additional object of the invention is to provide a counter which is of eye-pleasing appearance in spite of the provision of one or more motors or other types of actuators for the front panel or panels.

Still another object of the invention is to provide a counter wherein the weight of the front panel or panels need not be borne by the customary supports forming part of the upper portion of the case.

A further object of the invention is to provide a counter wherein the extent of movability of the front panel or panels relative to the adjacent parts of the counter can be selected and adjusted within any desired practical range.

Another object of the invention is to provide a counter wherein several front panels can be moved jointly or independently of each other.

An additional object of the invention is to provide the counter with safety features which prevent motor-induced movements of one or more front panels when the front panels do not assume predetermined optimum starting positions.

A further object of the invention is to provide a novel and improved method of assembling the above outlined counter.

Another object of the invention is to provide a novel and improved method of grouping certain component parts of the counter into modules to simplify the assembly of the counter and to facilitate completion of such assembly within a short period of time.

SUMMARY OF THE INVENTION

The invention is embodied in a counter, particularly in an article of furniture for temporary storage, cooling and simultaneous displaying of commodities (e.g., foodstuffs) in supermarkets or other establishments where the customers or visitors are supposed to observe but normally should not gain access to displayed commodities. The improved counter comprises a case having a front or customer side which is faced by customers when the counter is set up in an establishment, and a rear or service side opposite the front side. The case includes a lower portion and a hollow upper portion on top of the lower portion. The upper portion comprises a plurality of spaced apart hollow supports which extend forwardly and upwardly at the rear side of the case and each of which has an upper end and a lower end, and the counter further comprises at least one front panel (e.g., a panoramic panel which consists of transparent or translucent material), hinges which are provided at the upper ends of the supports and serve to articulately connect the at least one panel with the supports for movement of the front panel about a fixed substantially horizontal axis between a first position in which the at least one panel overlies the front side of the case and a raised second position in which the at least one panel affords access into the hollow upper portion at the front side of the case, and means for moving the at least one panel. The moving means includes a linear actuator in at least one of the supports, and the actuator comprises a first member (e.g., a hollow elongated cylinder, means for articulately coupling the first member of the actuator to the lower end of the at least one support, a second member (e.g., a piston, a plunger or a piston rod-like member which is reciprocable in and extends upwardly beyond the first member), and means for articulately connecting the second member to the hinge at the upper end of the at least one support. The connecting means is spaced apart from and is located at a level above and preferably forwardly of the coupling means. The actuator further comprises means for converting electric power, hydraulic power or another available power into linear motion of the second member. Each support can confine a discrete actuator.

The connecting means defines for the second member a second substantially horizontal axis which is at least substantially parallel to the first axis and moves along an arcuate path in response to movement of the second member relative to the first member to thereby vary the distance of the connecting means from the coupling means. The center of curvature of the arcuate path is or can be located on the fixed axis.

The actuator, the coupling means and the connecting means can form part of a prefabricated and preassembled module which is insertable into and withdrawable from the at least one support. Such module preferably further comprises a frame for the coupling means, and the hinge at the upper end of the at least one support includes a pintle which is preferably mounted in the frame of the module. The frame can include a plurality of separable components and the actuator is confined between the components of such frame. The components of the frame can include two elongated frame members which flank the actuator. The frame members have first ends which are connected to each other by the coupling means and the second ends which are connected to each other by the pintle of the hinge at the upper end of the at least one support.

The frame preferably extends downwardly and rearwardly beyond the lower end of the actuator. An internal surface of the at least one support can constitute a track for guidance of the module during insertion into or during withdrawal from the at least one support. The upper end of the at least one support has an opening for insertion or withdrawal of the module, and the counter further comprises means (e.g., one or more threaded fasteners) for fastening the inserted module to the at least one support. The lower portion of the case has a top surface which preferably serves as an abutment for the lower end of the frame.

The profile (cross-sectional outline) of the at least one support preferably includes a substantially U-shaped section and a substantially semicircular section which latter is preferably adjacent the internal space of the hollow upper portion of the case. The at least one support can be provided with at least one elongated groove at the apex of the substantially semicircular section of its profile. Such apex can constitute a slightly or fully flattened portion or facet of the semicircular section of the profile, and the at least one groove is preferably an undercut (e.g., T-shaped) groove which serves to receive and confine a complementary male portion of an attachment, such as a bracket, in the internal space of the upper portion of the case. The attachment is preferably adjustable in the longitudinal direction of the at least one support and can serve to carry a shelf for commodities which are displayed in the internal space of the upper portion of the case.

If the actuator comprises means for converting electric power into linear motion of the second member of the actuator, such converting means can be installed in at least one of the first and second members. One of the first and second members can be provided with a first opening (e.g., the lower end of the first member can be provided with an opening), and the lower end of the at least one support can be provided with a second opening. A conductor (e.g., a flexible electric cable) is connected to the converting means and extends outwardly from the at least one support through the first and second openings to have its plug connected to an outlet or to another suitable source of electrical energy.

The means for converting electric power can comprise an externally threaded spindle element (e.g., a feed screw) which is connected with one of the first and second members, an internally threaded nut element which mates with the spindle element and is connected with the other of the first and second members, and means for rotating one of these elements relative to the other element to thereby move the second member relative to the first member of the actuator.

The second member of the actuator is movable relative to the first member between a lower end position corresponding to the first position of the at least one front panel and an upper end position corresponding to the raised second position of the at least one front panel. The converting means can comprise an electric motor which serves to move the second member (e.g., through the medium of the spindle element and nut element), first and second switches in circuit with the electric motor and preferably positioned adjacent the second member, at least one trip which is movable with the second member to engage one of the switches in the upper end position and to engage the other switch in the lower end position of the second member, and means (e.g., in the form of elongated rotary screws or spindles) for adjusting the positions of the switches relative to the trip or trips. The adjusting means are accessible at the upper end of the support. The switches can operate as limit switches which open the circuit when the motor has completed the movement of the second member to the respective end position.

The counter (especially a rather long counter) can be designed in such a way that its supports include spaced apart first and second (outer) supports and a third support preferably midway between the first and second supports. The at least one front panel is disposed between the first and third supports, and a second front panel of such counter is installed between the second and third supports. The hinges of such counter include a hinge at the upper end of each of the first and second supports and two hinges at the upper end of the third support. Each of these two hinges articulately connects one of the two panels to the third support and, if the counter has a single actuator, this single actuator is disposed in the third support. The connecting means of the counter with two front panels includes means for articulately connecting the second member of the actuator to each of the two hinges at the upper end of the third support.

The means for articulately connecting the second member of the actuator to each of the two hinges at the upper end of the third support preferably comprises at least one clutch which is operable to establish or interrupt a motion transmitting connection between the second member and at least one of the two hinges at the upper end of the third support. The second member has an upper end between the two hinges and the at least one clutch has a motion transmitting element (e.g., a cylindrical pin or stud) at the upper end of the second member and a motion receiving element on each of the two hinges. The motion transmitting element is movable between a first position of engagement with one of the motion receiving elements and a second position of engagement with the other motion receiving element. The motion transmitting and receiving elements are coaxial in the first positions of the front panels, and the motion receiving elements can comprise sleeves. The pin-or stud-shaped motion transmitting element is movable axially of the sleeves and into and out of a selected sleeve in the first positions of the front panels to thereby establish a motion transmitting connection between the second member of the actuator and the one or the other of the two hinges at the upper end of the third support. The arrangement may be such that the motion transmitting element engages only one of the motion receiving elements in each of its positions. However, the motion transmitting and motion receiving elements can be designed and mounted in such a way that, when the two front panels are held in their first positions, the motion transmitting element is further movable to a third position of simultaneous engagement with each of the motion receiving elements so that the actuator can simultaneously move both panels between their first and second positions.

The counter can further comprise means for moving the motion transmitting element between its positions, namely between its first and second positions or between its first, second and third positions, depending on the selected design of the at least one clutch.

The third support can be provided with at least one aperture which is aligned with the motion transmitting element and with at least one of the motion receiving elements in the first positions of the front panels. The means for moving the motion transmitting element can comprise displacing means movable in the at least one aperture to shift the motion transmitting element to a selected position relative to the motion receiving elements. The arrangement is preferably such that the third support is provided with two apertures which are aligned with the motion transmitting and motion receiving elements in the first positions of the front panels. The displacing means then comprises a first pusher which is movable in one of the apertures to shift the motion transmitting element into engagement with one of the motion receiving elements in the first position of the respective front panel, and a second pusher which is movable in the other aperture to shift the motion transmitting element into engagement with the other motion receiving element in the first position of the corresponding front panel.

The displacing means can further comprise means for moving the pushers relative to the third support; such moving means can comprise a substantially U-shaped yoke which straddles the third support and includes a first leg which is connected with one of the pushers and a second leg which is connected with the other pusher. The pushers can be spaced apart from each other a fixed distance in each position of the motion transmitting element; this is satisfactory when the motion transmitting element is to be moved to only two positions. Alternatively, the yoke can further comprise means for movably connecting the two legs to each other so that the two pushers are movable toward and away from each other. The means for movably connecting the two legs can comprise a variable-length web between the two legs; such web can comprise first and second portions which are respectively connected with the first and second legs and one of which is slidably telescoped into the other.

The means for moving the pushers relative to each other can comprise at least one prime mover, and such prime mover can comprise at least one electromagnet.

The diameter of the pin-shaped motion transmitting element preferably exceeds the diameter(s) of the aperture(s) in the third support.

The counter can further comprise means for monitoring the position of the motion transmitting element relative to the motion receiving elements and for blocking the operation of the actuator except when the motion transmitting element assumes at least one predetermined position relative to the motion receiving elements. The monitoring means can comprise means for indirectly monitoring the position of the motion transmitting element, e.g., by way of the legs of the aforementioned yoke and/or one or more other parts of the means for moving the motion transmitting element. The arrangement is preferably such that the operation of the actuator is blocked when the motion transmitting element is disengaged from each of the motion receiving elements.

The novel features which are considered as characteristic of the invention are set forth in particular in the appended claims. The improved counter itself, however, both as to its construction and the mode of using the same, together with additional features and advantages thereof, will be best understood upon perusal of the following detailed description of certain presently preferred specific embodiments with reference to the accompanying drawing.

BRIEF DESCRIPTION OF THE DRAWING

FIG. 4 is an enlarged section view of the support and of the actuator therein, substantially as seen in the direction of arrows from the line IV—IV in FIG. 2;

FIG. 5 is an enlarged fragmentary sectional view substantially as seen in the direction of arrows from the line V—V in FIG. 2;

FIG. 6 is an enlarged sectional view substantially as seen in the direction of arrows from the line VI—VI in FIG. 2;

FIG. 9 is an enlarged front elevational view of another component of the module in the support of FIGS. 2 to 6;

DESCRIPTION OF PREFERRED EMBODIMENTS

Figure 1:
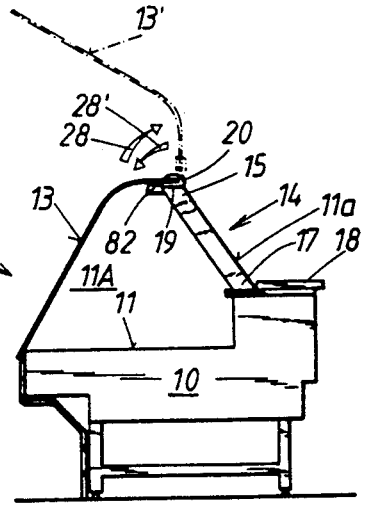
FIG. 1 is a schematic end elevational view of a counter which embodies one form of the invention and comprises a single front panel, the first position of the panel being shown by solid lines and the second position of the panel being shown by phantom lines.

The counter which is shown in FIGS. 1 to 9 comprises a case 10 (FIG. 1) having a lower portion 11 and a hollow upper portion **11*a* located on top of the lower portion 11 and having an internal space 11A. The internal space 11A can accommodate commodities (e.g., foodstuffs) which can be observed at the front or customer side 12 of the case 10. The attendant or attendants stand or sit at the rear or service side 14 of the case 10. As a rule, the customer side 12 of the case 10 is closed and preferably sealed by a panoramic front panel 13 which can be made of light-transmitting glass or plastic material. FIG. 1 shows the panel 13 in a first position (by solid lines) as well as in a raised second position (indicated by broken lines, as at 13') in which the panel 13 affords access into the internal space 11A from the front or customer side 12 of the case 10. This is convenient to the sales persons and/or to other attendants, e.g., to those in charge of replacing commodities in the internal space llA, of removing spoiled commodities or of removing acceptable commodities at the end of the day or at the end of the week, or of cleaning the interior of the upper portion 11*a* of the case 10** at regular intervals or when the need arises.

The rear side 14 of the case 10 can remain open so that an attendant can immediately reach one or more selected commodities in the internal space 11A. Alternatively, the rear side 14 can be normally closed and preferably sealed by sliding doors or other types of doors which can be manipulated by the person or persons behind the counter. The sides 12 and 14 will normally be closed and sealed if the commodities in the internal space llA are perishable and must be maintained at a certain temperature or within a certain temperature range below room temperature. In many instances, the counter of the present invention will constitute a refrigerator of the type used in supermarkets, delicatessen, ice cream parlors, sandwich shops and like establishments wherein the commodities must be cooled or kept frozen but should be readily accessible to the sales person or persons.

The front panel 13 is mounted at the upper ends of at least two elongated hollow supports 15 which are mounted on the lower portion 11 and form part of the frame of the upper portion **11*a* of the case 10. Each support 15 extends from the lower portion 11 forwardly and upwardly and is located at the rear side 14 of the case 10. The supports 15 are or can be identical with each other. For example, the upper portion 11*a* can comprise two supports 15 which are located at the two longitudinal ends of the front panel 13. However, it is equally possible to mount the panel 13 on three or more preferably equidistant hollow supports 15, particularly if the panel 13** is rather long and heavy (e.g., because it contains a plurality of glass panes or panes made of other light-transmitting (transparent or translucent) material.

The presently preferred profiles (cross-sectional outlines) 16 of the hollow supports 15 are shown in FIGS. 4 to 6.

Figure 3:
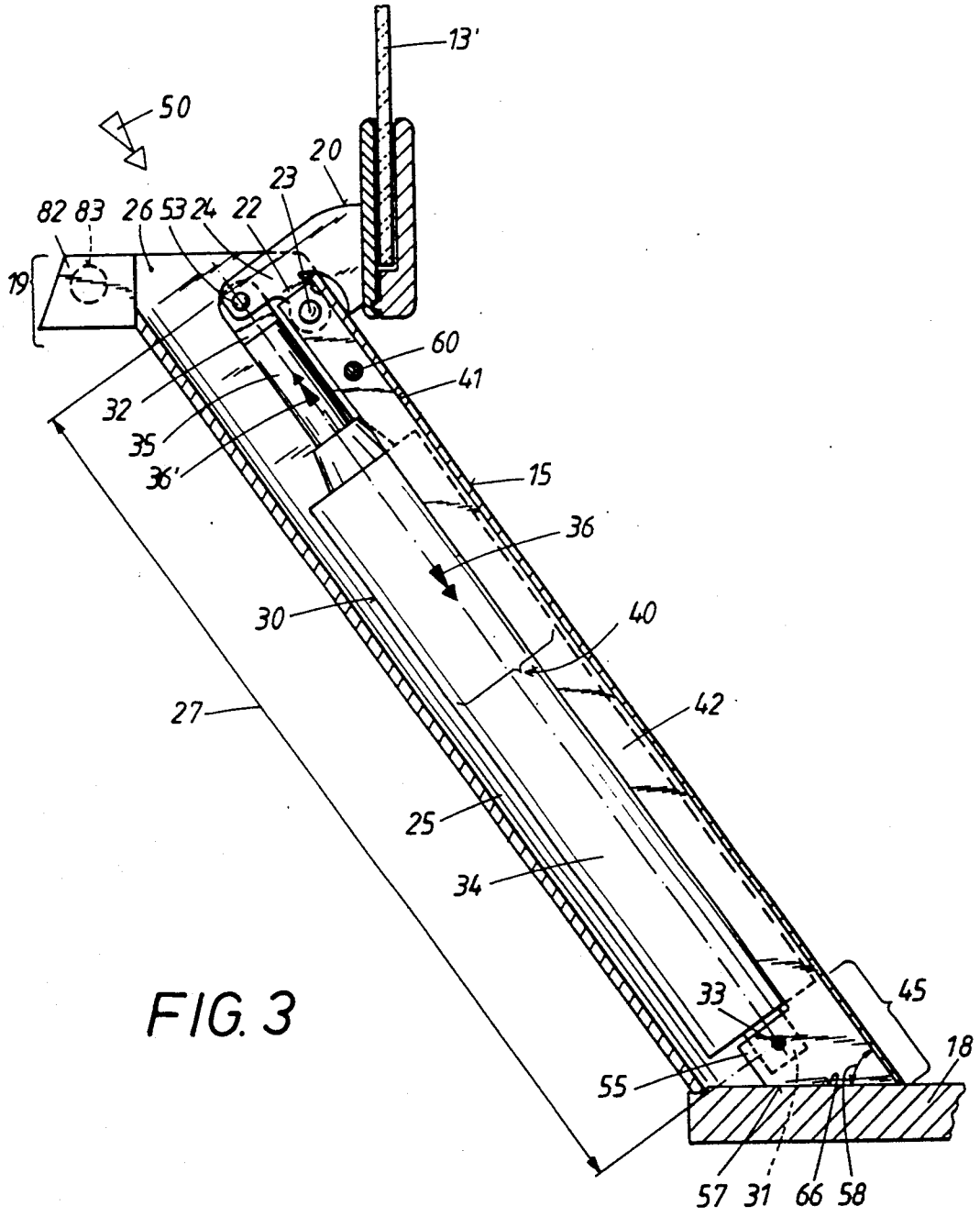
FIG. 3 is a similar vertical sectional view of the support but showing the movable member of the actuator in that end position in which the actuator maintains the front panel in the raised position, the section of FIG. 3 being taken in the direction of arrows substantially as seen from the line III—III in FIG. 6.

The inclination of all supports 15 which mount the panel 13 is preferably the same. FIG. 3 shows that the angle 58 at which the supports 15 are inclined to the horizontal is a rather large acute angle. For example, the angle 58 can equal or approximate 45 degrees. Each support 15 is preferably straight and the upper end 19 of each such support confines a hinge 20 which movably connects the panel 13 to the respective support. Each hinge 20 has a pintle 23 which is (indirectly) mounted in the respective support 15 and defines for the upper rear edge portion of the panel 13 a fixed horizontal axis extending transversely of the longitudinal directions of the supports 15. The pintles 23 of all hinges 20 in the improved counter are coaxial. The lower ends 17 of the supports 15 are anchored in or are otherwise affixed to a horizontal table 18 forming part of the lower portion 11 of the case 10. The table 18 is used by the attendant or attendants for treatment of commodities (e.g., for packing, for the making of sandwiches or for anglogous purposes) or for temporary deposition of commodities which have been withdrawn from the internal space 11A or which are to be returned into the upper portion 11*a* of the case 10 after an inspection by a potential customer.

Each support 15 has an elongated internal space 25 which serves to accommodate a linear actuator 30 of the means for moving the panel 13 between its first and second positions as well as to accommodate a prefabricated and preassembled module 40 which includes or confines the respective actuator 30. The hinges 20 at the upper ends 19 of all supports 15 carry a pair of cooperating clamping rails 21, 62 (or pairs of discrete rails) which sealingly engage the elongated rear marginal portion 29 of the panel 13 and serve as a means for transmitting motion from the hinges 20 to the panel 13 in response to setting in motion of an upper or second member 35 of the actuator 30. Each support 15 preferably confines a discrete actuator 30 and the movements of upper or second members 35 of all actuators are preferably synchronized in order to avoid twisting of and eventual damage to the panel 13 as well as to ensure that the panel sealingly engages the frame of the upper portion 11*a* of the case 10 when it is permitted or caused to assume the first or operative position which is shown in FIG. 1 by solid lines and in which the panel prevents access to the internal space 11A from the customer side 12 of the case 10. The actuators 30 in the supports 15 are caused to pivot the rails 21, 62 in the direction of arrow 28 (FIG. 1) in order to move the panel 13 to the raised position 13', and in the direction of arrow 28' in order to gently return the panel to the solid-line (first) position.

Figure 2:
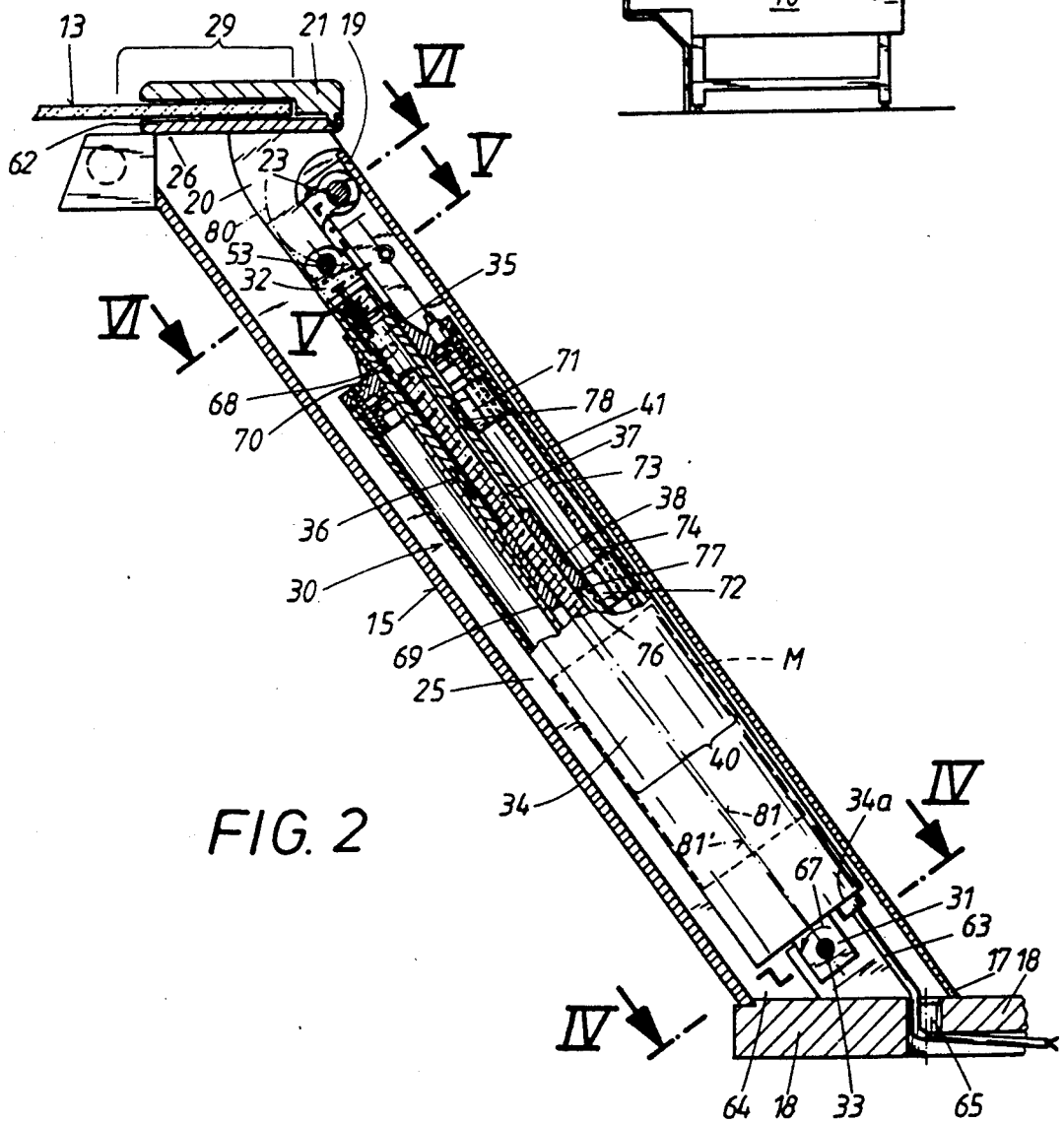
FIG. 2 is a longitudinal vertical sectional view of one of the supports in the counter of FIG. 1, the actuator in the counter being shown in a position in which it maintains the front panel in the first position and the section of FIG. 2 being taken in the direction of arrows substantially as seen from the line II—II in FIG. 6.

The actuator 30 which is shown in FIG. 2 is designed to convert electric power into substantially linear motion of the upper or second member 35. However, it is equally within the purview of the invention to employ actuators which are designed to convert hydraulic or pneumatic power into linear or substantially linear motion of the respective second members 35. The actuator 30 of FIG. 2 is preassembled with other parts of the module 40 prior to insertion of the fully assembled (prefabricated) module into the internal space 25 of the support 15.

In addition to the actuator 30, the module 40 of FIG. 2 comprises a frame 41 with components 42, 46, a shaft 33 which serves as a means for articulately coupling the lower end 31 of the lower or first member 34 of the actuator 30 to the frame 41, and a shaft 53 which serves as a means for articulately connecting the upper end 32 of the second member 35 of the actuator 30 to the hinge 20 at a certain distance from the pintle 23.

The details of the frame 41 are shown in FIGS. 4 to 6. The components 42 of this frame are two elongated parallel frame members (see also FIGS. 7 and 8) which flank the actuator 30 and the lower ends 45 of which are connected to each other by the shaft 33. The upper ends 43 of the frame members 42 have bearings 44 for the end portions of the pintle 23. That portion (22) of the hinge 20 which extends between and is connected with the pintle 23 and connecting shaft 53 is L-shaped (see particularly FIG. 3). The end portions of the pintle 23 can be upset or provided with cotter pins or the like to ensure that the pintle is held against axial movement relative to its bearings 44.

Figure 8:
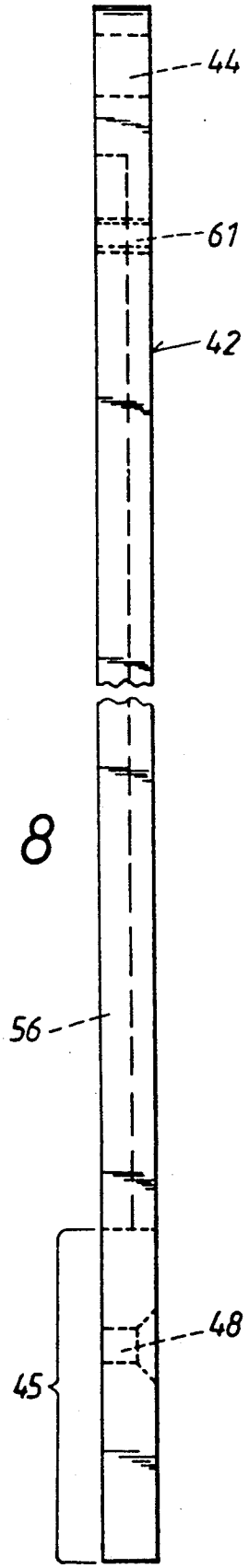
FIG. 8 is an end elevational view of the frame member.
Figure 7:
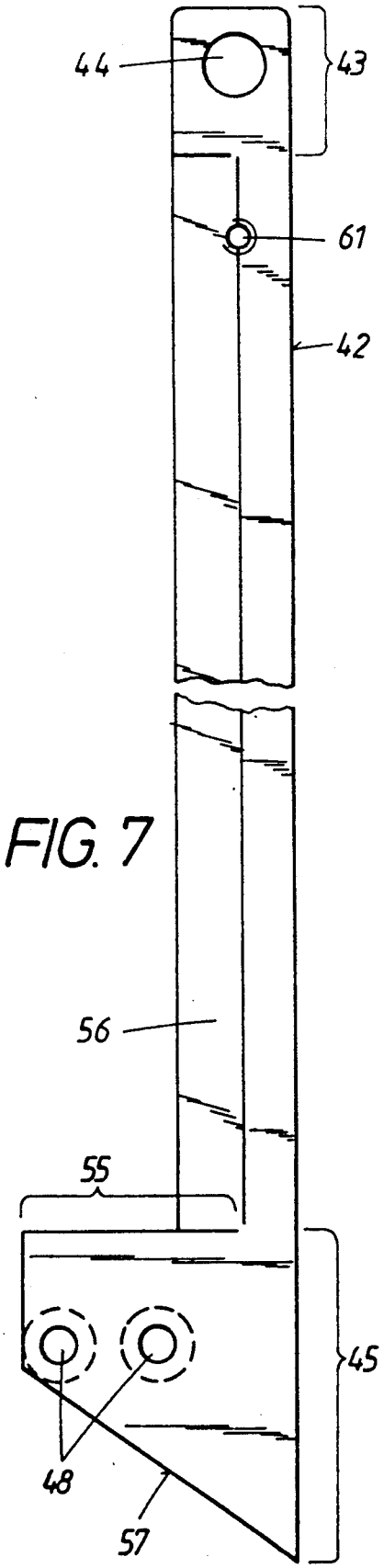
FIG. 7 is a side elevational view of a frame member in the module within the support which is shown in FIGS. 2 to 6.

The manner in which the shaft 33 is connected to the lower ends 45 of the frame members 42 is or can be the same as described in connection with the pintle 23 and the upper ends 43 of the frame members 42, i.e., each lower end 45 can be provided with a bearing for the respective end portion of the shaft 33 and this shaft is held against axial movement in any suitable way. FIGS. 3, 7 and 8 show that the lower ends 45 of the illustrated frame members 42 are enlarged to constitute forwardly extending plate-like lugs 55. The end portions of the shaft 33 extend only into the components 46 of the frame 41 (see FIG. 4), and such components are inwardly adjacent the lugs 55 at the lower ends 45 of the frame members 42. The configuration of one of the components 46 is shown in FIG. 9; this component is a square plate which has a hole 49 for the respective end portion of the shaft 33 and two tapped bores or holes 47 for reception of screws or other threaded fasteners which connect the component 46 to the lug 55 at the lower end 45 of the respective frame member 42. To this end, the frame members 42 have tapped holes 48 for the shanks of such threaded fasteners. The heads of the threaded fasteners are or can be recessed into the frame members 42. The lugs 55 at the lower ends 45 of the frame members 42 abut the adjacent end faces of the shaft 33 (FIG. 4) to hold the shaft against axial movement relative to the lower end 31 of the first member 34 of the actuator 30. The lower end 31 is articulately connected to the frame 42 in that it is free to pivot about the axis of the shaft 33. FIG. 3 shows that the lugs 55 at the lower ends 45 of the frame members 42 extend downwardly and rearwardly beyond the lower end 31 of the first member 34 of the actuator 30. The lower edge faces or undersides 57 of these lugs abut the top surface 66 of the table 18 when the support 15 is properly mounted on the lower portion 11 of the case 10.

The lower or first member 34 of each actuator 30 preferably constitutes an elongated hollow cylinder the lower end 31 of which is pivotably mounted on the respective shaft (coupling means) 33. The second or upper member 35 of the actuator 30 extends into and is movable relative to the first member 34 in order to vary the distance of its upper end 32 and shaft 53 from the lower end 31 and shaft 33. The member 35 can constitute a tube, piston, plunger or a like part which is reciprocable in directions indicated in FIG. 3 by arrows 36 and 36'. The member 35 will move in the direction of arrow 36 in order to pivot the front panel 13 back to the solid-line first position of FIG. 1. When caused to move in the direction of arrow 36', the member 35 compels the front panel 13 to move toward the raised second position 13' of FIG. 1 or 3. In order to enable the members 34 and 35 to pivot about the axis of the shaft 33 during movement of the member 35 in the direction of arrow 36 or 36', the frame members 42 of the frame 41 are provided with cutouts 56 (shown in FIGS. 5 and 7) so that the frame 41 does not interfere with pivotal movements of the members 34, 35 between the angular positions of FIGS. 2 and 3. Such pivotal movements take place because the shaft (connecting means) 53 is spaced apart from and is parallel to the pintle 23. The pintle 23 is mounted in the bearings 44 in the upper ends 43 of the frame members 42 but the shaft 53 is free to move relative to the pintle 23 along an arcuate path 80 having its center of curvature on the fixed axis of the pintle.

The underside or lower edge face 57 at the lower end 45 of each frame member 42 (i.e., the underside of each lug 55) is preferably flush with and abuts the top surface 66 of the table 18 forming part of the lower portion 11 of the case 10. This enhances the stability of the respective support 15.

The shaft 53 is mounted in the upper end 32 of the second member 35 and in the arm 24 of the portion 22 of the respective hinge 20. This can be seen in FIGS. 3 and 6. FIG. 6 shows that the arm 24 constitutes a bifurcated part of the L-shaped portion 22 and the upper end 32 of the second member 35 of the actuator 30 is located in the slot 75 between the two prongs of the arm 24. The end portions of the shaft 53 can be a tight fit in the aligned holes of the respective prongs of the portion 24, and the upper end 32 is then free to turn about the median portion of the shaft 53.

The module 40 including the frame 41, the actuator 30, the hinge 20 with its pintle 23, and the shafts 33, 53 can be prefabricated and fully assembled by a manufacturer of hardware (e.g., a maker of hinges or like articles). The maker of the major part of the counter utilizes such prefabricated modules 40 in the internal spaces 25 of the supports 15 to ensure that the front panel 13 is properly (movably) connected with the supports 15 and can be pivoted between its first and second positions. The length of the modules 40 is determined by the length of the supports 15. For example, the maker or assembler of counters will maintain a supply of each of two or more different types of modules 40 to enable the maker or assembler to employ differently inclined, differently dimensioned and/or differently configurated supports 15, depending on the desired size and shape of the counters.

The profile 16 of the support 15 which is shown in FIGS. 4 to 6 includes a substantially U-shaped rear or outer section 51 at the outer side of the upper portion 11*a* of the case 10 and a substantially semicircular inner or front section 52 which is located in the internal space llA. The apex of the semicircular section 52 is flattened or facetted, as at 54, and is formed with two elongated parallel undercut grooves 59 (e.g., T-grooves) which extend longitudinally of the support 15. The purpose of the grooves 59 is to receive complementary male portions of brackets or like attachments (not shown) which extend into the internal space llA of the upper portion 11*a* and serve to support shelving for displayed commodities. The male portions of the attachments can be moved longitudinally of the respective grooves 59 in order to move the shelving to positions at different distances from the upper side of the lower portion 11 of the case 10. The attachments can be fixed in selected positions by screws or in any other suitable way.

The upper end 19 of each support 15 has an opening 26 (FIG. 2) which permits insertion and withdrawal of the respective module 40. The direction in which a module 40 can be inserted is indicated in FIG. 3 by an arrow 50. The internal surface 39 (FIG. 4) of the support 15 serves as a track to facilitate predictable and rapid introduction of the module 40 into the internal space 25. When the module 40 reaches an optimum position in the internal space 25 of the respective support 15, it is releasably secured in such position by suitable fastener means. FIGS. 3 and 5 show threaded fasteners 60 (e.g., standard screws) which extend through holes in the hollow support 15 and into tapped bores or holes 61 in the adjacent frame members 42 of the properly inserted module 40. The pintle 23 of the hinge 20 is then maintained in an optimum position relative to the upper end 19 of the support 15 and the rails 21, 62 are ready to engage the elongated rear marginal portion 29 of the front panel 13. FIG. 5 shows two threaded fasteners 60 each of which secures a discrete frame member 42 to the adjacent portion of the shell of the hollow support 15.

In the embodiment which is shown in FIGS. 1 to 9, the length of the frame members 42 is selected in such a way that the undersides 57 of their lugs 55 abut the top surface 66 of the table 18 when the pintle 23 is in an optimum position with reference to the upper end 19 of the support 15, i.e., when the shanks of the screws 60 are free to pass through the holes in the shell of the support 15 and into the registering tapped bores or holes 61 of the adjacent frame members 42.

The rails 21 and 62 can be properly connected with the rear marginal portion 29 of the front panel 13 in a first step prior to being secured to the hinges 20 of the modules 40 in two or more supports 15 of the upper portion 11*a* of the case 10.

Since the actuator 30 comprises a reversible electric motor M (indicated in FIG. 2 by broken lines), the lower end of the first member 34 of the actuator 30 is provided with an opening 34*a* and the lower end of the support 15 is also provided with an opening 64 for an electrical conductor 63 (e.g., a standard flexible electric cable) one end of which is secured to the motor M and the other end of which carries a plug (not shown) for insertion into a wall outlet, a floor outlet or any other suitable source of electrical energy. The cable 63 further extends through an opening 65 in the table 18 of the lower portion 11 of the case 10.

The table 18 of the lower portion 11 of the case 10 carries the full weight of each module 40. The shell of each hollow support 15 is not acted upon by any pronounced forces and, therefore, this shell is or can be relatively thin (see FIGS. 4 to 6). This results in substantial savings in expensive material (such as aluminum) of which the supports 15 are made.

The weight of the front panel 13 need not be carried by the supports 15. Thus, and since the pintles 23 of the hinges 20 are mounted in the upper ends 43 of the preferably solid and very sturdy frame members 42 which are fully confined in the internal spaces 25 of the respective supports 15, the frame members 42 carry the weight of the front panel 13 when the latter dwells in the first or raised position as well as during pivoting of the front panel in the direction of arrow 28 or 28'. Thus, any and all pronounced stresses are taken up by the frame members 42 and are transmitted directly to the massive table 18 of the lower portion 11 of the case 10. This ensures that the profile 16 of each support 15 is not distorted.

The linear arcuator 30 is an elongated slender unit which occupies a relatively small amount of space in spite of the fact that the first or lower portion 34 must pivot (in and counter to the direction indicated by arrow 67 in FIG. 2) when the effective length of the actuator 30 changes as a result of movement of the second member 35 in the direction of arrow 36 or 36'. The distance 27 (FIG. 3) of the axis of the shaft 33 from the tip of the upper end 32 of the second member 35 varies whenever the shaft 53 is caused to move along the aforementioned arcuate path 80 about the fixed axis of the pintle 23 which is mounted in the bearings 44 provided therefor in the upper ends 43 of the frame members 42.

The motor M in the first portion 34 of the linear actuator 30 is a reversible d-c motor the circuit of which can be completed by operating an on-off switch 104 (FIG. 12) in the connection between the electric cable 63 and the energy source. The switch 104 is preferably installed at the rear side 14 of the case 10 within reach of the person or persons behind the table 18. The switch 104 is designed in such a way that it can complete the circuit of the motor M in two different ways, namely to move the second member 35 of the actuator 30 in the direction of arrow 36 or 36'. The output element of the motor M can drive a rotary externally threaded spindle or feed screw 37 which is journalled in the cylindrical first member 34 and meshes with a nut 38 fixedly mounted in the (non-rotatable but longitudinally movable) second member 35. It is preferred to provide a suitable transmission (not shown), e.g., a planetary transmission, between the output element of the motor M and the spindle 37. The directions of rotation of the spindle 37 are indicated by a double-headed arrow 68 (FIG. 2). As shown in FIG. 2, the spindle 37 can extend well into the tubular second member 35 of the elongated actuator 30.

The second member 35 is reciprocable is a longitudinally slotted tubular shroud 69 which is non-rotatably held in a closure or top wall 70 at the open upper end of the first member 34.

If the electric motor M is replaced with a double-acting cylinder and piston unit (not shown), the spindle 37 and the nut 38 are replaced with a piston and piston rod assembly which can move the second member 35 or which can constitute the second member of the thus modified hydraulically or pneumatically operated linear actuator. Still further, it is possible to employ a magnetically operated linear actuator without departing from the spirit of the invention.

When the motor M is started in a direction to push the member 35 in the direction of arrow 36', the shaft 53 causes the respective hinge 20 to turn its L-shaped portion 22 in a clockwise direction (arrow 28) about the fixed axis of the pintle 23 and to gradually move the front panel 13 from the solid-line position to the phantom-line position 13' of FIG. 1. The shaft 53 shares the upward movement of the member 35 and its movement along the arcuate path 80 about the fixed axis of the pintle 23 entails a certain angular movement of the lower or first member 34 about the axis of the shaft 33 in the direction of arrow 67. The hinge 20 has a cutout (shown in FIG. 3) which receives the adjacent upper edge portion of the shell of the support 15 when the front panel 13 approaches and reaches the raised second position 13' of FIG. 3. The cutout is provided in that part of the hinge 20 which is located above the L-shaped portion 22.

The motor M is arrested by a limit switch 71 which is engaged by a trip 76 when the member 35 of the actuator 30 reaches its upper end position, i.e., when the pivoting of the front panel 13 to its raised position 13' is completed. The limit switch 71 is mounted in the interior of the actuator 30 (e.g., in the member 34) and is operated by the trip 76 to open the circuit of the motor M when the member 35 reaches the upper end position of FIG. 3.

The exact position of the limit switch 71 (i.e., its distance from the shaft 33) can be adjusted in the following way: The first member 34 carries two elongated externally threaded adjusting members 73, 74 which are parallel to the members 34, 35 and the heads of which are accessible at the upper side of the cover 70 for the member 34 (see FIGS. 2 and 6). The limit switch 71 has a tapped bore for a portion of the adjusting member 73 and this switch has a follower (FIG. 2) extending into a longitudinally extending slot of the shroud 36. Thus, when the adjusting member 73 is rotated clockwise or counterclockwise, the limit switch 71 moves up or down to change its distance from the shaft 33. The second adjusting member 74 serves for adjustment of the level of a second limit switch 72 which is engaged by the trip 76 to open the circuit of the motor M when the mobile second member 35 of the actuator 30 reaches its lower end position, i.e., when the front panel 13 reassumes the solid-line first position of FIG. 1. The trip 76 can be provided on or can form part of the nut 38 which moves up and down with the second member 35 of the actuator 30. That portion of the limit switch 72 which can be engaged by the trip 76 in the upper end position of the member 35 is shown at 77, and that portion of the limit switch 71 which can be engaged by the trip 76 in the lower end position of the member 35 is shown at 78. Adjustability of the level of the switch 71 enables the person in charge to select the raised position 13' of the front panel 13, i.e., to select the extent of angular movability of the panel from its first position in which the internal space llA of the upper portion **11*a* is not accessible at the customer side 12 of the case 10. Adjustability of the level of the switch 72 is desirable and advantageous because this enables the person in charge to ensure that the motor M is arrested at the very instant when the front panel 13 sealingly engages the front side of the upper portion 11*a*** of the case.

The heads at the upper ends of the adjusting members 73 and 74 are readily accessible through the opening 26 at the upper end 19 of the respective support 15 when the front panel 13 is held in the raised position 13'.

As already mentioned above, the phantom line 80 denotes in FIG. 2 the arcuate path of movement of the shaft 53 about the fixed axis of the pintle 23 while the second member 35 of the actuator 30 moves in the direction of arrow 36 or 36'. The center of curvature of the path 80 is or can be located on the axis of the pintle 23. The first member 34 of the actuator 30 is compelled to turn about the axis of the shaft 33 in or counter to the direction of arrow 67 due to the fact that a shortening or lengthening of the actuator entails a movement of the shaft 53 along the arcuate path 80.

The angular movement of the member 34 about the axis of the shaft 33 is relatively small. FIG. 2 shows the axis 81 of the lower member 34 in the first position of the front panel 13. This axis assumes the position 81' when the member 35 reaches its upper end position, i.e., when the pivoting of the panel 13 to the raised position 13' is completed. FIG. 4 shows (at 79) the extent to which the actuator 30 can pivot in the shell of the support 15 without striking the inner side of the facet 54 of the inner section 52 of the profile 16. The clearance is relatively small because the angle between 81 and 81' in FIG. 2 is very small. Thus, the dimensions of the shell of the support 15 need not be unduly increased for the purpose of preventing such shell from obstructing the movements of the members 34, 35 about the axis of the shaft 33. Moreover, when in the foremost positions (FIG. 3), the members 34, 35 extend into the preferably semicircular section 52 of the profile 16 which provides ample room for pivoting of the members 34, 35 in a counterclockwise direction (as viewed in FIGS. 2 and 3).

FIG. 3 shows that the upper end 19 of the support 15 can carry the reflector 83 of a light source 82 (e.g., a fluorescent lamp or an incandescent lamp) which serves to illuminate the internal space 11A of the upper portion 11*a* of the case 20.

The mounting of each module 40 in a manner (as shown in FIGS. 2 and 3) namely that the undersides 57 of the lower ends 45 of the frame members 42 lie flat against the top surface 66 of the table 18) constitutes a presently preferred mode of installing the modules. However, if the supports 15 are relatively long (see FIG. 11), such supports can accommodate relatively short linear actuators 30 the lower ends 31 of which need not be closely adjacent the table 18. The lower shafts 33 or the lower ends 45 of the frame members 42 are then mounted in the shells of the respective hollow supports, i.e., such supports then take up all forces which develop as a result of pivoting of the front panel or panels between its or their first and second positions as well as the entire weight of the respective modules and of the front panel or panels. It is then desirable to employ a requisite number of fasteners 60 in order to reliably secure each module 40 to the shell of the respective support. For example, each module 40 can be affixed to the respective support by at least two fasteners 60 (or analogous fasteners) at the upper ends of the respective frame members 42 and by at least two fasteners at the lower ends of such frame members.

FIGS. 10 to 13 show certain details of a modified counter with two pivotable front panels 13 and 113. The front panel 13 is mounted between a first outer hollow support 15 and an intermediate (third) hollow support 15', and the panel 113 is mounted between a second outer support 15 and the intermediate or third support 15'. The case of the modified counter is shown at 10'. All such parts of the modified counter which are identical with or clearly analogous to corresponding parts of the counter of FIGS. 1 to 9 are denoted by similar reference characters. The profile 16' of the support 15' is similar to but not identical with the profiles of the supports 15.

Figure 10:
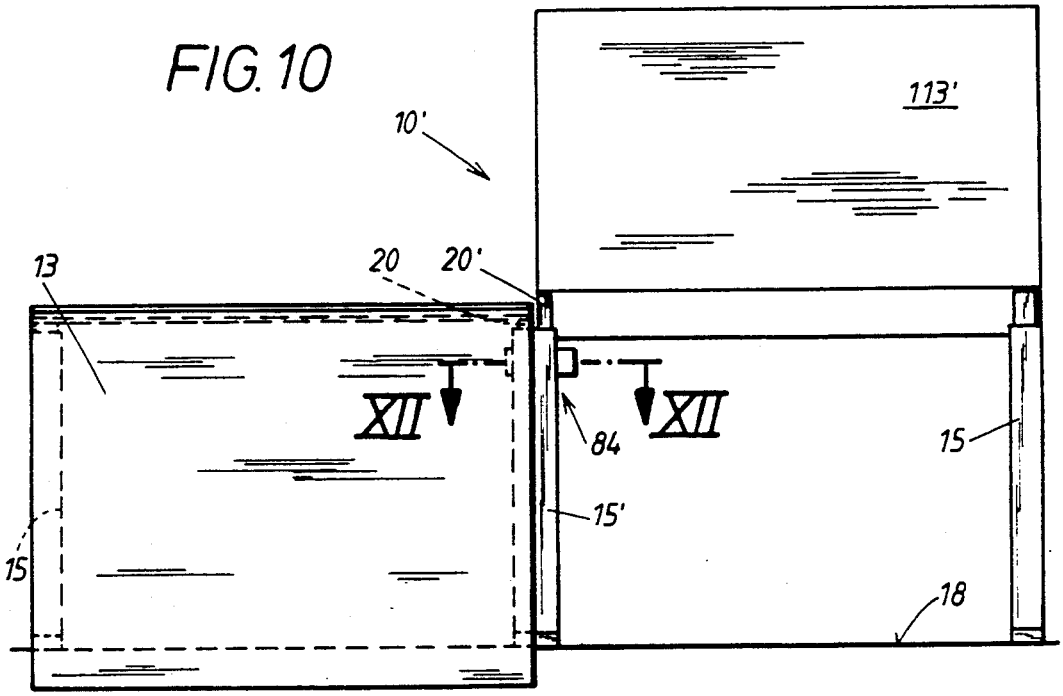
FIG. 10 is a front elevational view of the upper portion of the case in a modified counter with two pivotable front panels one of which is shown in the first and the other of which is shown in the second position.
Figure 11:
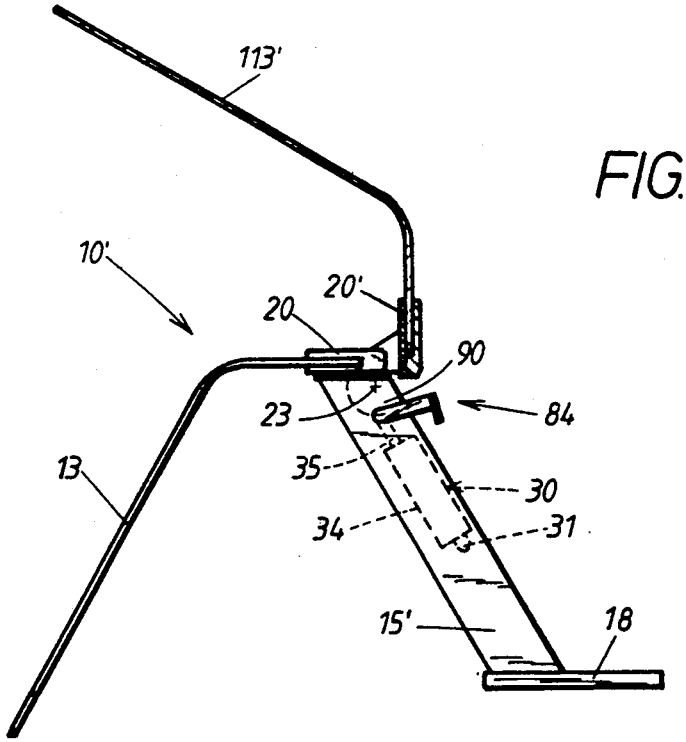
FIG. 11 is an end elevational view of the counter of FIG. 10.
Figure 12:
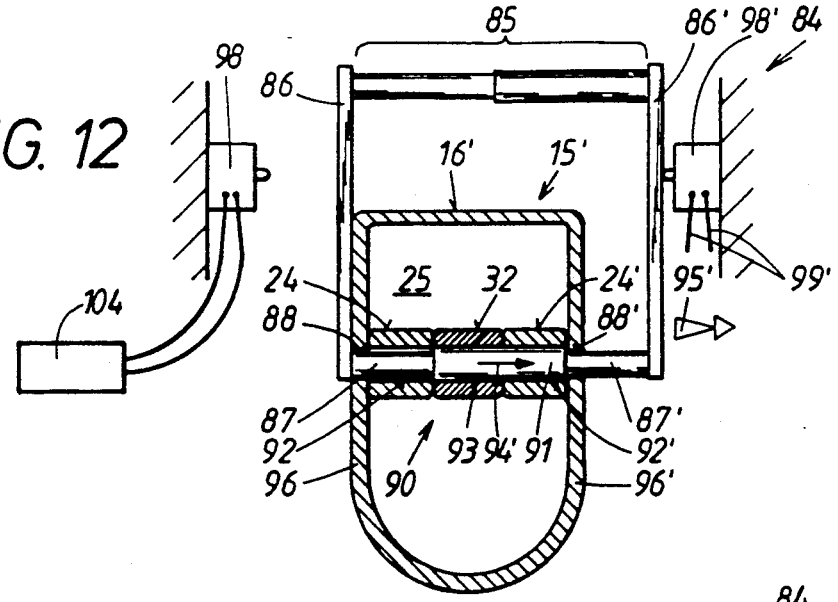
FIG. 12 is an enlarged substantially horizontal sectional view as seen in the direction of arrows from the line XII XII of FIG. 10 and shows a clutch which serves to connected the actuator in the median support of the modified counter with one of the two panels, the, parts of the clutch being shown in positions in which the actuator is coupled to the right-hand panel of FIG. 10.
Figure 13:
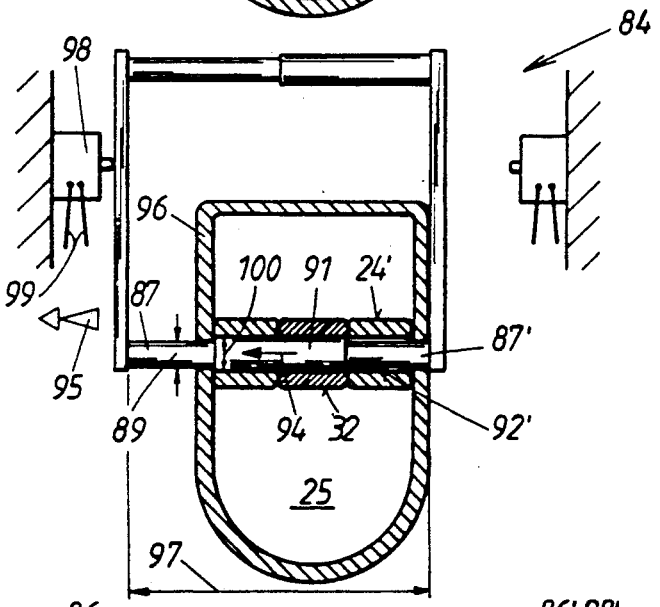
FIG. 13 illustrates the structure of FIG. 12 but with the parts of the clutch in positions they assume when the actuator is coupled to the left-hand panel of FIG. 10.
Figure 14:
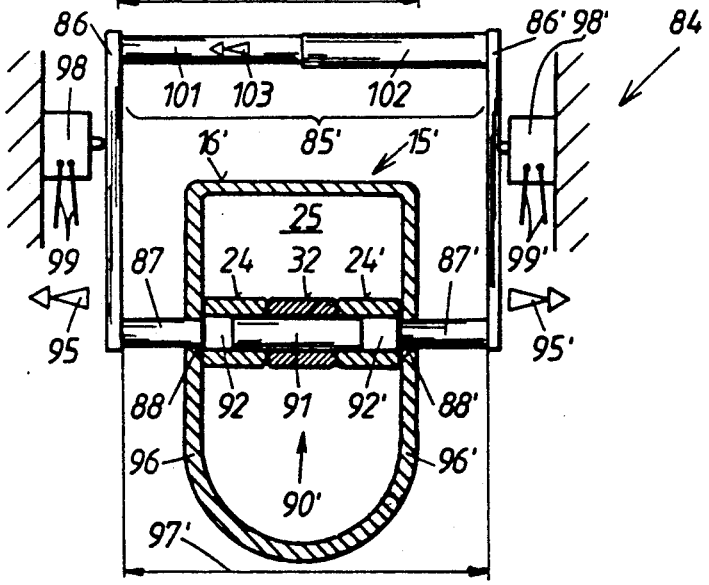
FIG. 14 is a view similar to that of FIGS. 12 and 13 but showing a modified clutch which can perform the functions of the clutch of FIGS. 12–13 as well as the function of coupling the actuator with both front panels.

FIGS. 10 and 11 show the panel 13 in the first position and the panel 113 in the raised second position 113'. Each outer support 15 carries a single hinge (not shown) which is or can be identical with the hinge 20 of FIGS. 2, 3 and 6. The third support 15' carries two hinges 20 and 20' one of which is connected to the adjacent end portion of the panel 13 and the other of which is connected to the adjacent end portion of the panel 113. The hinges 20, 20' at the upper end of the support 15' receive motion from a single linear actuator 30 which, as shown in FIG. 11, need not extend all the way to the table 18 of the lower portion of the case 10'. In order to ensure that the panel 13 can be pivoted relative to the panel 113 as well as that the panel 113 can be pivoted relative to the panel 13, the means for transmitting motion from the second member 35 of the actuator 30 in the support 15' to the hinges 20, 20' comprises a clutch 90 which can be engaged in two different ways, namely to transmit motion from the member 35 to the hinge 20 or to transmit motion from the member 35 to the hinge 20'. The arms 24, 24' of the hinges 20, 20' flank the upper end 32 of the second member 35 of the actuator 30 (see FIGS. 12 and 13). The clutch 90 is installed in the internal space 25 of the support 15'. In FIG. 12, the clutch 90 is engaged to transmit motion from the upper end 32 of the member 35 to the arm 24' of the hinge 20' for the front panel 113, and FIG. 13 shows the clutch 90 in a condition in which the upper end 32 transmits motion to the arm 24 of the hinge 20 for the front panel 13. FIG. 14 shows a modified clutch 90' which is designed in such a way that it can couple the upper end 32 of the member 35 with the hinge 20 and/or 20', i.e., it is possible to pivot the panels 13, 113 as a unit between their respective first and second positions.

The clutch 90 of FIGS. 12 and 13 comprises a pin- or stud-shaped motion transmitting element 91 (hereinafter pin) and two substantially sleeve-like motion receiving elements 92, 92' (hereinafter sleeves). The pin 91 can be shifted axially in directions which are indicated by arrows 94 and 94'. When moved in the direction of arrow 94, the pin 91 penetrates into the sleeve 92 and establishes a motion transmitting connection between the upper end 32 of the member 35 and the hinge 20 for the panel 13 (FIG. 13). When moved in the direction of arrow 94' (FIG. 12), the pin 91 enters the sleeve 92' and establishes a motion transmitting connection between the upper end 32 and the hinge 20' for the panel 113.

The means (shown at 84) for moving the pin 91 in directions which are indicated by arrows 94 and 94' comprises a yoke which straddles the support 15' and includes a web 85 having a fixed length, and two legs 86, 86' which are rigid with the respective ends of the web 85. The free end of the leg 86 carries a first displacing or shifting member 87 (hereinafter called pusher) which can shift the pin 91 axially in the direction of arrow 94', and the free end of the leg 86' carries a second displacing or shifting member or pusher 87' which can move the pin 91 axially in the direction of arrow 94. The substantially parallel walls 96, 96' of the shell of the support 15' has two aligned apertures 88 and 88' for the pushers 87 and 87' respectively. The sleeve 92 on the arm 24 of the hinge 20 is aligned with the aperture 88 and hence with the sleeve 92 and with the pin 91 when the front panel 13 assumes its first or closed position, i.e., when the upper end 32 of the member 35 maintains the pin 91 in the lower end position. Analogously, the sleeve 92' on the arm 24' of the hinge 20' is aligned with the opening 87' and with the pin 91 when the panel 113 is held in the first or closed position, i.e., when the member 35 assumes its lower end position. The pusher 87 holds the hinge 20 against movement relative to the support 15' when the pin 91 is received in the sleeve 92', and the pusher 87' fixes the hinge 20' to the support 15' when the pin 91 is received in the sleeve 92. The arrow 95' (FIG. 12) indicates the direction of movement of the pushers 87 and 87' in order to enable the pusher 87 to advance the pin 91 into the sleeve 92', and the arrow 95 (FIG. 13) denotes the direction of movement of the pushers 87, 87' in order to enable the pusher 87' to advance the pin 91 into the sleeve 92.

As mentioned above, the web 85 of the yoke which forms part of the moving means 84 is rigid, i.e., the distance (97 in FIG. 13) of the arms 86, 86' from each other is constant. In order to move the panel 13 from the first position to the second or raised position, the upper end 32 of the member 35 is moved to its lower end position so that the pin 91 (which is reciprocable in a bearing 93 of the upper end 32) is aligned with the sleeve 92 on the hinge 20 and with the apertures 88, 88'. The yoke 85, 86, 86' is then moved in the direction of arrow 95 in order to enable the pusher 87' to propel the pin 91 into the sleeve 92 so that the member 35 is coupled to and can pivot the hinge 20 and the front panel 13 to the raised position. At such time, the panel 113 is assumed to dwell in the first position. If the person in charge wishes to return the panel 13 to the closed or first position of FIGS. 10 and 11, the actuator 30 is caused to move its member 35 to the lower end position so that the upper end 32 of the member 35 return the pin 91 and the sleeve 92 into alignment with the sleeve 92' and with the apertures 88, 88'. The panels 13, 113 then remain in the first positions as long as desired or necessary. If the panel 113 is to be pivoted to the raised position, the yoke 85, 86, 86' is caused to move the pushers 87, 87' in the direction of arrow 95' so that the pusher 87 expels the pin 91 from the sleeve 92 and causes the pin to enter the sleeve 92'. The member 35 is then coupled to the hinge 20' and can pivot the front panel 113 to the raised position 113' or back to the first position. At such time, the panel 13 remains in the first position.

The pin 91 extends only into the sleeve 92 in one end position of the yoke (FIG. 13) and only into the sleeve 92' in the other end position of the yoke. In other words, the clutch 90 can connect the member 35 to the hinge 20 or to the hinge 20'.

The positions of the yoke 85, 86, 86' (and hence of the pin 91) are monitored by two limit switches 98 and 98' which are outwardly adjacent the support 15' and are mounted in the upper portion of the case 10'. Conductors 99' which are connected with the limit switch 98' transmit signals when the movement of the yoke to the end position of FIG. 12 is completed, and the conductors 99 for the limit switch 98 transmit signals when the movement of the yoke to the end position of FIG. 13 is completed. The limit switches 98, 98' can serve to partially complete the circuit of the motor M in the actuator 30 when the yoke 85, 86, 86' reaches the one or the other end position, i.e., when the member 35 of the actuator 30 is properly coupled to the hinge 20 or 20' at the upper end of the support 15'. The motor M is then ready to be started in response to actuation of the on-off switch 104 (shown schematically in FIG. 12) so that the actuator 30 can move the panel 13 or the panel 113 to the raised position.

The pusher 87 does not extend into the internal space 25 of the support 15' (i.e., this pusher does not extend beyond the inner side of the wall 96) in that end position of the yoke (FIG. 13) in which the pin 91 couples the member 35 to the hinge 20. This ensures that the yoke does not interfere with movements of the member 35 and hinge 20. Analogously, the pusher 87' is fully extracted from the internal space 25 when the yoke assumes the end position of FIG. 12 so that the yoke and the hinge 20 cannot interfere with movements of the member 32 and hinge 20' relative to the hinge 20 and support 15'. As mentioned above, the pusher 87 can further serve as a means for locking the panel 13 in the first position when the member 35 is free to move the hinge 20' and the panel 113 because the pusher 87 then extends into the sleeve 92 (FIG. 12) which is rigid with the hinge 20. Furthermore, the pusher 87' can block the panel 113 in the first position when the member 35 is free to move the hinge 20 and the panel 13 because the pusher 87' then extends into the sleeve 92' (FIG. 13) to thus hold the panel 113 against movement from the first position.

The diameters of the apertures 88, 88' are preferably smaller than the diameter 100 (FIG. 13) of the pin 91. This ensures that the pin 91 cannot enter one of these apertures in the one or the other end position of the yoke. Furthermore, such selection of the diameters of the pin 91 and apertures 88, 88' ensures that the pushers 87, 87' can displace the pin 91 even if the sleeves 92, 92' are not in optimum alignment with the adjacent apertures in the first positions of the respective sleeves. The pin 91 is prevented from entering the aperture 92 or 92' on the additional ground that the free end of the pusher 87' is preferably in the plane of the inner side of the wall 96' when the yoke assumes the end position of FIG. 12 and the free end of the pusher 87 is in the plane of the inner side of the wall 96 in the other end position (FIG. 13) of the yoke. The diameters 89 (FIG. 13) of the pushers 87, 87' can match or closely approximate the diameters of the respective apertures 88, 88'. The diameters 89 are smaller than the diameter 100 of the pin 91.

FIG. 14 shows the modified clutch 90' which enables the actuator 30 to move the panels 13 and 113 as a unit between their first and second positions. To this end, the pin 91 of the clutch 90' is movable between two end positions corresponding to those shown in FIGS. 12 and 13 as well as to a third or intermediate position (as actually shown in FIG. 14) in which approximately or exactly one-half of the pin 91 extends into the sleeve 92 and the other half of the pin extends into the sleeve 92'. The yoke of the displacing means 84 of FIGS. 12 and 13 is replaced with a modified yoke forming part of moving means 84' and having a web 85' of variable length, i.e., the legs 86 and 86' of the yoke can be moved closer to or further away from each other. To this end, the web 85' of the yoke of FIG. 14 comprises two coaxial portions 101, 102 the former of which is slidably telescoped into the latter.

The two halves of the yoke which is shown in FIG. 14 can be moved with or relative to each other. Thus, when the left-hand half of the yoke is held in the position of FIG. 14 and the right-hand half is pushed or pulled toward the limit switch 98 (arrow 95), the portion 102 of the web 85' receives a greater part of the portion 101 and the pusher 87' shifts the pin 91 into the sleeve 92 while expelling the pin from the sleeve 92', i.e., the upper end 32 of the member 35 is then connected only to the hinge 20 and panel 13. The pressure upon the depressible portion of the limit switch 98 then suffice to generate a signal which is transmitted via conductor means 99 and permits completion of the circuit of the motor M (not shown in FIG. 14) by way of the on-off switch 104).

If the person in charge wishes to pivot the panel 113 (while the panel 13 remains in the first position), the right-hand half of the yoke (including the leg 86') is maintained in the end position of FIG. 14 and the left-hand half (including the leg 86) is pushed or pulled in the direction of arrow 95' so that the pusher 87 expels the pin 91 from the sleeve 92 and causes the pin to enter the sleeve 92'. The member 35 including the upper end 32 is then connected with the hinge 20' but is disconnected from the hinge 20, i.e., the panel 113 can be moved between its first and raised positions while the pusher 87 blocks the sleeve 92 and the hinge 20 so that the panel 13 is compelled to remain in the first position. The limit switch 98' then transmits a signal via conductors 99'.

If the operator wishes to simultaneously pivot the panels 13 and 113, the two halves of the yoke are moved to the positions of FIG. 14 (this entails a movement of the web portion 101 relative to the web portion 102 in the direction of arrow 103) so that one-half of the pin 91 extends into the sleeve 92 and the other half of the pin extends into the sleeve 92', i.e., the actuator 30 is then ready to pivot the panels 13, 113 as a unit because the upper end 32 of the member 35 is connected to the hinge 20 as well as to the hinge 20'.

The two halves of the yoke can begin their movements toward the positions of FIG. 14 from neutral or intermediate positions in which the legs 86, 86' are respectively spaced apart from the limit switches 98 and 98'. This ensures that at least a portion of the pin 91 extends into the sleeve 92 while the remaining portion of the pin extends into the sleeve 92'. The upper portion of the case 10' can be provided with a scale or with other suitable indicating means which is adjacent the web 101, 102 and facilitates the task of an operator in moving the two halves of the yoke to their aforementioned neutral positions in which the pushers 87, 87' cooperate to maintain the pin 91 substantially midway between the walls 96, 96' of the support 15' before the legs 86, 86' are shifted to the end positions of FIG. 14 in order to retract the pushers 87, 87' from the internal space 25 of the support 15' so that these pushers do not interfere with movements of the hinges 20 and 20' relative to the support. Either of the limit switches 98, 98' can prepare the circuit of the motor M for completion by the on-off switch 104 when the legs 86, 86' reach the positions which are shown in FIG. 14. The distance between the legs 86 and 86' is variable between the maximum distance 97' (FIG. 14) and a minimum distance corresponding to the fixed distance 97 shown in FIG. 13. The length of the yoke 85' varies between the maximum length shown in FIG. 14 and a minimum length corresponding to the fixed length of the yoke 85 which is shown in FIGS. 12 and 13.

It is also within the purview of the invention to provide a prime mover e.g., an electromagnet or other suitable means (not shown) for moving the yoke 85 between the two end positions of FIGS. 12 and 13 or for moving the yoke 85' of FIG. 14 between the positions corresponding to those shown in FIGS. 12, 13 and the position of FIG. 14. Such prime mover can receive signals from control panel at the service side of the case 10'.

An important advantage of the improved counter is that the front panel 13 or 113 is reliably held in the raised second position as long as necessary. This holds true irrespective of the size and weight of the front panel 13 and/or 113. The actuator 30 ensures gradual and smooth movements of each front panel between its first and second positions. Moreover, the appearance of the improved counter is pleasing to the eye because the actuator or actuators are fully concealed from view in the first position or positions of the front panel or panels and are practically fully concealed from view in the second position of the single panel (FIGS. 1-9) or in the second position of at least one of plural panels (FIGS. 10-14).

Each actuator 30 is an elongated slender structure which can be readily confined in the frame 41 of the respective module 40, and each such module can be confined in the respective support 15 or 15'. The positions of the members 34 and 35 can be reversed, i.e., the end 32 of the member 35 can be articulately connected to the shaft 33 and the end 31 of the member 34 can be articulately connected to the shaft 53 or can carry the pin 91 of the clutch 90 or 90'.

Each actuator 30 is preferably designed in such a way that the panel or panels can be moved to the aforediscussed first and second positions as well as to any one of a practically infinite number (or a limited number) of intermediate positions. All that is necessary is to actuate the switch 104 when the panel or panels reach the desired angular position(s). The means (M, 37, 38) for converting electric power into linear movements of the member 35 then acts as a brake or a blocking device which reliably maintains the panel or panels in the selected intermediate position(s). Thus, it is not necessary to provide any separate or additional means for the purpose of maintaining the panel 13 of FIGS. 1-9 or either of the panels 13, 113 shown in FIGS. 10-11 in a selected intermediate position.

The appearance of the actuator or actuators 30 is immaterial because each actuator is confined in the respective support, i.e., the appearance of the counter is determined solely by the portions of the case 10 or 10' and by the front panel or panels. The motor M can set the respective member 35 in motion without abrupt acceleration which is particularly desirable if the front panel or panels are rather large and heavy. It has been found that, by properly selecting the output of the motor M, an actuator 30 of the type shown in FIGS. 2 and 3 can readily pivot one or more very large and heavy front panels including those which include plural light-transmitting panes and that the motor or motors can reliably hold such heavy panel or panels in any desired intermediate position without the need for locking bolts or other separate parts.

The grouping of an actuator 30, a frame 41, one or two hinges (20 or 20, 20') and shafts 33, 53 or shaft 33 and clutch 90 or 90' into a prefabricated module simplifies the assembly of the improved counter as well as the removal of an actuator for the purposes of inspection, repair or replacement. The frame 41 reinforces the module 40 and lends stability to the support 15 or 15' in which the module 40 is installed. The hinge or hinges at the upper end of a support automatically assume the optimum position(s) relative to a single front panel or relative to the respective front panels when the insertion and fixing of a module 40 in its support is completed. It is then merely necessary to connect the rear marginal portion(s) of the front panel or panels to the respective hinge or hinges. The feature that the hinge or hinges are assembled with the frame 41 and with the actuator 30 prior to insertion of the module 40 into a support 15 or 15' contributes significantly to simplicity of the assembly of a counter and entails considerable savings in time. The pintle 23 and the shaft 53 (or the clutch 90 or 90' and the pintle 23) are concealed when the module 40 is properly installed in the respective support 15 or 15'.

As already explained above and as shown in FIGS. 1 to 9, the module 40 can further serve to take up stresses including the weight of the front panel or panels and the forces which develop while a panel is caused to pivot between its first and second positions. All that is necessary is to mount the module on the lower portion of the case 10 or 10' and to use the respective support primarily as a decorative enclosure for the module. This renders it possible to employ a lightweight and inexpensive support having a thin shell.

The module 40 can be simplified in a number of ways. For example, the number of components to be assembled into a frame 41 can be reduced; in fact, it is even possible to employ a one-piece frame. A frame 41 which employs at least two discrete parts, such as the frame members 42, is preferred at this time because this facilitates assembly of the frame with the actuator and other parts of the module. There is no need for the provision of separate fasteners to hold the components of the frame together; such function can be performed by the shaft 33 and by the pintle or pintles 23. Since the lower ends 45 of the frame members 42 extend downwardly and beyond the shaft 33, the lower end 31 of the member 34 is free to pivot about the axis of this shaft and the actuator need not rest directly on any part of the respective support 15 or 15'.

The adjusting members 73 and 74 are accessible at the upper end of the respective support 15 or 15' to permit rapid changes of the level of the respective switches 71, 72 and hence the selection of first and second positions of the front panel or panels.

Though it is possible to replace the intermediate support 15' of FIGS. 10 and 11 with two separate supports 15 each of which contains an actuator 30, or to design the support 15' in such a way that it contains two discrete actuators 30 (one for the hinge 20 and the other for the hinge 20'), the construction which is shown in FIGS. 10-14 is preferred because it entails savings in space as well as a reduction of the initial and assembly cost.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A counter, particularly an article of furniture for temporary storage, cooling and simultaneous displaying of commodities in supermarkets and other establishments, comprising a case having a front side which is faced by customers in an establishment and a rear side opposite said front side, said case including a hollow upper portion comprising a plurality of spaced apart hollow supports disposed at said rear side and each having an upper end and a lower end; at least one front panel; hinges provided at said upper ends and articulately connecting said at least one panel to said supports for movement about a fixed substantially horizontal axis between a first position in which said at least one panel overlies said front side and a second position in which said panel affords access into said hollow upper portion at said front side; and means for moving said panel between said first and second positions, including a linear actuator in at least one of said supports, said actuator comprising a first member, means for articulately coupling said first member to the lower end of said at least one support, a second member movable with respect to said first member, a motor operable to move said second member relative to said first member, and means for articulately connecting said second member to the hinge at the upper end of said at least one support so that the hinge at the upper end of said at least one support moves said panel between said first and second positions exclusively in response to motor-induced movement of said second member relative to said first member, said connecting means being spaced apart from said coupling means.

2. The counter of claim 1, wherein said actuator further comprises means for converting electric power into linear motion of said second member, said motor forming part of said converting means.

3. The counter of claim 1, wherein said connecting means defines for said second member a second substantially horizontal axis which is substantially parallel to said fixed axis and moves along an arcuate path in response to movement of said second member relative to said first member to thereby vary the distance of said connecting means from said coupling means.

4. The counter of claim 3, wherein said arcuate path has a center of curvature on said fixed axis.

5. The counter of claim 3, wherein said actuator, said coupling means and said connecting means form part of a prefabricated module which is insertable into and withdrawable from said at least one support.

6. The counter of claim 5, wherein said module further comprises a frame for said coupling means, the hinge at the upper end of said one support having a pintle which is mounted in said frame and defines said fixed axis.

7. The counter of claim 6, wherein said frame includes a plurality of separable components and said actuator is confined between the components of said frame.

8. The counter of claim 7, wherein said components include two elongated frame members which flank said actuator, said frame members having first ends connected to each other by said coupling means and second ends which are connected to each other by said pintle.

9. The counter of claim 6, wherein said first member has a lower end said frame extends downwardly beyond the lower end of said first member at the lower end of said at least one support.

10. The counter of claim 5, wherein said at least one support has an internal surface which constitutes a track for guidance of said module during insertion into or withdrawal from said at least one support.

11. The counter of claim 5, wherein the upper end of said at least one support has an opening for insertion or withdrawal of said module, and further comprising means for fastening the inserted module to said at least one support.

12. The counter of claim 11, wherein said fastening means comprises at least one threaded fastener.

13. The counter of claim 5, wherein said module further comprises a frame for said coupling means and said actuator, the hinge at the upper end of said at least one support having a pintle which is mounted in said frame and said case further including a lower portion having a top surface, said frame having a lower end abutting said top surface.

14. The counter of claim 1, wherein said at least one support has a profile including a substantially U-shaped section and a substantially semicircular section.

15. The counter of claim 14, wherein said upper portion has an internal space and said substantially semicircular section of said profile is adjacent said internal space.

16. The counter of claim 14, wherein said substantially semicircular section has an apex and said at least one support has at least one elongated external groove at said apex.

17. The counter of claim 16, wherein said apex constitutes a flattened portion of said substantially semicircular section and said at least one groove is an undercut groove arranged to receive and confine a complementary male portion of an attachment, such as a bracket.

18. The counter of claim 1, wherein said actuator further comprises means for converting electric power into linear motion of said second member, said converting means including said motor and being installed in at least one of said first and second members, one of said first and second members having a first opening, said at least one support having a second opening at said lower end thereof and further comprising electric conductor means connected to said converting means and extending outwardly from said at least one support through said openings.

19. The counter of claim 1, wherein said actuator comprises means for converting electric power into linear motion of said second member, said converting means including said motor and further including an externally threaded spindle element connected with one of said first and second members and an internally threaded nut element mating with said spindle element and connected to the other of said first and second members, said motor having means for rotating one of said elements relative to the other of said elements to thereby move said second member relative to said first member.

20. The counter of claim 1, wherein said actuator comprises means for converting electric power into linear motion of said second member and said converting means includes said motor, said second member being movable relative to said first member between a lower end position corresponding to the first position and an upper end position corresponding to the second position of said panel, said motor comprising an electric motor and said converting means further comprising first and second switches in circuit with said motor and adjacent said second member, at least one trip movable with said second member to engage one of said switches in the upper end position and to engage the other of said switches in the lower end position of said second member, and means for adjusting the positions of said switches relative to said trip.

21. The counter of claim 1, wherein said supports include spaced apart first and second supports and a third support between said first and second supports, said front panel being disposed between said first and third supports and further comprising a second front panel between said second and third supports, said hinges including a hinge at the upper end of each of said first and second supports and two hinges at the upper end of said third support, each of said two hinges articulately connecting one of said panels to said third support and said actuator being provided in said third support, said connecting means including means for articulately connecting said second member to said two hinges.

22. The counter of claim 21, wherein said means for articulately connecting said second member to said two hinges comprises at least one clutch which is operable to establish or interrupt a motion transmitting connection between said second member and at least one of said two hinges.

23. The counter of claim 22, wherein said second member has an upper end between said two hinges, said at least one clutch having a motion transmitting element at the upper end of said second member and a motion receiving element provided on each of said two hinges, said motion transmitting element being movable between a first position of engagement with one of said motion receiving elements and a second position of engagement with the other of said motion receiving elements.

24. The counter of claim 23, wherein said elements are coaxial in the first positions of said panels and said motion receiving elements include sleeves, said motion transmitting element including a pin movable axially of said sleeves and into and out of a selected one of said sleeves.

25. The counter of claim 23, wherein said motion transmitting element engages only one motion receiving element in each of said first and second positions thereof.

26. The counter of claim 25, wherein said motion transmitting element is further movable to a third position of engagement with each of said motion receiving elements.

27. The counter of claim 26, further comprising means for moving said motion transmitting element between said positions thereof.

28. The counter of claim 24, further comprising means for moving said motion transmitting element between said positions thereof.

29. The counter of claim 28, wherein said third support has at least one aperture in alignment with said motion transmitting element and in alignment with at least one of said motion receiving elements in the first position of the respective panel, said means for moving said motion transmitting element comprising displacing means movable in said at least one aperture to shift said motion transmitting element to a selected position relative to said motion receiving elements.

30. The counter of claim 29, wherein said third support has two apertures which are aligned with said motion receiving elements in the first positions of said panels, said displacing means comprising a first pusher movable in one of said apertures to shift said motion transmitting element into engagement with one of said motion receiving elements in the first position of the respective panel and a second pusher movable in the other of said apertures to shift said motion transmitting element into engagement with the other of said motion receiving elements in the first position of the respective panel.

31. The counter of claim 30, wherein moving means further comprises means for moving said pushers relative to said third support.

32. The counter of claim 31, wherein said means for moving said pushers comprises a substantially U-shaped yoke which straddles said third support and includes a first leg connected with one of said pushers and a second leg connected with the other of said pushers.

33. The counter of claim 31, wherein said pushers are spaced apart from each other a fixed distance in each position of said motion transmitting element.

34. The counter of claim 32, wherein said yoke further comprises means for movably connecting said legs to each other so that said pushers are movable toward and away from each other.

35. The counter of claim 34, wherein said means for movably connecting said legs comprises a web having first and second portions respectively connected with said first and second legs, one portion of said web being slidably telescoped into the other portion of said web.

36. The counter of claim 34, wherein said means for movably connecting said legs to each other comprises a variable-length web.

37. The counter of claim 31, wherein said means for moving said pushers relative to said third support includes at least one prime mover.

38. The counter of claim 37, wherein said prime mover comprises at least one electromagnet.

39. The counter of claim 29, wherein said motion transmitting element includes a pin having a first diameter and said at least one aperture has a second diameter smaller than said first diameter.

40. The counter of claim 28, further comprising means for monitoring the position of said motion transmitting element and for blocking the operation of said actuator except in at least one predetermined position of said motion transmitting element relative to said motion receiving elements.

41. The counter of claim 40, wherein said monitoring means includes means for indirectly monitoring the position of said motion transmitting moving said motion transmitting element.

42. The counter of claim 26, further comprising means for blocking the operation of said actuator when said motion transmitting element is disengaged from each of said motion receiving elements.

* * * * *